US012767194B2

(12) United States Patent
Naseer et al.

(10) Patent No.: US 12,767,194 B2
(45) Date of Patent: Oct. 20, 2026

(54) EARLY WARNING SYSTEM FOR SHOVE TRACK PROTECTION

(71) Applicant: Miller Felpax Corporation, Winona, MN (US)

(72) Inventors: Muhammad Mohsin Naseer, Lahore (PK); Mukhtiar Ahmad, Lahore (PK); Haider Ali, Lahore (PK); Brent Fransen, Winona, MN (US); Joseph Montgomery, Winona, MN (US); Kevin Pilger, Lewiston, MN (US); Randy Skarlupka, Winona, MN (US); Kevin Smith, Ponte Vedra Beach, FL (US); Richard Spitzer, Winona, MN (US)

(73) Assignee: MILLER FELPAX CORPORATION, Winona, MN (US)

( * ) Notice: Subject to any disclaimer, the term of this patent is extended or adjusted under 35 U.S.C. 154(b) by 482 days.

(21) Appl. No.: 18/371,343

(22) Filed: Sep. 21, 2023

(65) Prior Publication Data

US 2024/0101172 A1 Mar. 28, 2024

Related U.S. Application Data

(60) Provisional application No. 63/377,136, filed on Sep. 26, 2022.

(51) Int. Cl.
*B61L 23/06* (2006.01)
*B61L 25/02* (2006.01)

(52) U.S. Cl.
CPC ..... *B61L 23/06* (2013.01); *B61L 25/025* (2013.01)

(58) Field of Classification Search
CPC ..... B61L 1/14; B61L 17/023; B61L 23/06; B61L 25/025; B61L 27/70
See application file for complete search history.

(56) References Cited

U.S. PATENT DOCUMENTS 3,892,377 A 7/1975 Hathaway
6,829,536 B2 12/2004 Moore
(Continued)

FOREIGN PATENT DOCUMENTS

WO WO-2023014467 A1 * 2/2023 ..... H04W 4/80
WO WO-2024072674 A1 * 4/2024 ..... B61L 23/06

OTHER PUBLICATIONS

US 6,748,658, 02/2005, McAllister (withdrawn).
(Continued)

*Primary Examiner* — Jason C Smith
(74) *Attorney, Agent, or Firm* — Stinson LLP

(57) ABSTRACT

System and methods are disclosed to promote safe shoving movements of a train based on train position localization without human-based track operations monitoring. Train position detectors deployed at the end of a track, in parallel to the track, between the rails of the track, or a combination thereof, localize an end-of-train during shoving movements. Each train position detector transmits an early warning alert to an onboard alert device and a handheld alert device for indicating the end of the train is about to enter a pre-configured prohibited zone. The locomotive operator receives the alert on the onboard alert device while workers in the railyard receive the alert on the handheld alert devices. Both onboard and handheld alert devices are capable of generating audio, visual, haptic, or a combination of these warning alerts for the locomotive operator and the workers in the railyard.

20 Claims, 7 Drawing Sheets

(56) References Cited

U.S. PATENT DOCUMENTS

| | | | | |
|---|---|---|---|---|
| 7,200,470 | B2 | 4/2007 | Oguma et al. | |
| 7,624,952 | B1 | 12/2009 | Bartek | |
| 8,109,474 | B2 | 2/2012 | Bartek | |
| 8,296,000 | B2 | 10/2012 | Denny et al. | |
| 8,344,877 | B2 | 1/2013 | Sheardown et al. | |
| 8,752,797 | B2 * | 6/2014 | Carlson | B61L 29/282 246/122 R |
| 8,786,428 | B2 * | 7/2014 | Sheardown | B61L 23/06 246/477 |
| 8,812,227 | B2 * | 8/2014 | Carlson | G08G 1/166 701/300 |
| 9,061,692 | B1 * | 6/2015 | Dibble | B61L 25/025 |
| 9,227,642 | B2 * | 1/2016 | Huntimer | B61L 25/025 |
| 9,381,927 | B2 * | 7/2016 | Dimmer | B61L 25/025 |
| 9,545,852 | B2 * | 1/2017 | Streett | H02J 7/35 |
| 10,179,595 | B2 * | 1/2019 | Carlson | B61L 25/021 |
| 10,518,792 | B2 * | 12/2019 | Denny | B61L 27/70 |
| 10,752,272 | B2 * | 8/2020 | Bartek | G08B 21/02 |
| RE48,307 | E * | 11/2020 | Lingvall | B61L 29/28 |
| 10,889,310 | B2 * | 1/2021 | Bailey | B61L 23/14 |
| 10,896,589 | B2 | 1/2021 | Carlson | |
| 10,913,472 | B2 | 2/2021 | Bartek | |
| 10,926,783 | B2 | 2/2021 | Carlson et al. | |
| 2011/0278401 | A1 * | 11/2011 | Sheardown | B61L 23/06 246/167 A |
| 2014/0104081 | A1 * | 4/2014 | Cross | G08G 9/00 340/989 |
| 2016/0272228 | A1 * | 9/2016 | LeFebvre | H04L 67/12 |
| 2016/0280240 | A1 * | 9/2016 | Carlson | G01S 19/17 |
| 2017/0088046 | A1 * | 3/2017 | Denny | H04W 24/04 |
| 2017/0282944 | A1 * | 10/2017 | Carlson | G01S 19/17 |
| 2017/0320507 | A1 * | 11/2017 | Denny | E01F 9/30 |
| 2018/0093687 | A1 | 4/2018 | Bartek et al. | |
| 2019/0126956 | A1 * | 5/2019 | Roberts | B61L 23/34 |
| 2019/0256114 | A1 * | 8/2019 | Norris | B61L 27/70 |
| 2019/0300033 | A1 | 10/2019 | Carlson et al. | |
| 2020/0062286 | A1 | 2/2020 | Carlson et al. | |
| 2020/0162945 | A1 * | 5/2020 | Dan | H04W 24/04 |
| 2021/0001903 | A1 * | 1/2021 | Hilleary | B61L 27/70 |
| 2024/0101172 | A1 * | 3/2024 | Naseer | B61L 17/023 |

OTHER PUBLICATIONS

International Search Report dated Dec. 13, 2023, relating to PCT Application No. PCT/US2023/033233, 4 pages.

Written Opinion dated Dec. 13, 2023, relating to PCT Application No. PCT/US2023/033233, 11 pages.

* cited by examiner

EARLY WARNING SYSTEM FOR SHOVE TRACK PROTECTION

CROSS REFERENCE TO RELATED APPLICATION

This application claims the benefit of U.S. Provisional Patent Application No. 63/377,136, filed Sep. 26, 2022, the contents of which are incorporated by reference in their entirety for all purposes.

TECHNICAL FIELD

Aspects of the present disclosure generally relate to the fields of protection of trains, railyard infrastructure, and workers in railyards. More particularly, aspects of the present disclosure relate to safe train operations in a railyard during shove moves of the trains.

BACKGROUND

Train switching activities in a railyard typically include shove moves of the rolling stock in the railyard. Train switching is a process of sorting out the rolling stock into a complete train or separating a complete train into smaller fragments of rolling stock. A switching process can also be initiated when a train is to be attached or detached from the rolling stock. Changes in the order of rolling stock may also require switching. One method of train switching involves the use of the train to push or pull the rolling stock and place it on the designated tracks. The pushing or pulling consists of individual shove moves of the rolling stock inside the railyard. A shove move of the rolling stock outside the prescribed geographical limits is strictly prohibited and may result in damage to the train or railyard infrastructure and injuries to personnel.

Typically, the shove moves of the rolling stock require the presence of railyard personnel near the end of the track to monitor the position of the train and provide a timely warning to the train operator to stop further pushing of the train. This technique ensures that the operator stops the train before the end of the track is reached to avoid any damage to the train or railyard infrastructure. This human-based supervision is prone to error and can result in injury to the railroad staff or damage to the yard infrastructure due to the movement of the rolling stock on nearby tracks. Various accidents resulting in the loss of precious assets have been reported due to human errors during shove moves. The above-mentioned problems are in addition to the cost of human supervision in terms of working hours. The human-based supervision can be avoided by using real-time train position monitoring and providing an early warning to the train operator for stopping the train before reaching the end of the track.

Train operators require real-time end-of-train position information for performing safe shove moves inside a railyard. Based on the reported train position, the train operator may apply brakes before the train crosses the limits of the track and enters a prohibited zone. A shove track protection is based on two key mechanisms: first, monitoring the end-of-train position and second, providing an early warning to the train operator so that they may apply the brakes before the train reaches the prohibited zone. Typically, the location of the end of the train is monitored by railyard staff positioned at the end of the track. The human supervisors inform the train operator through a wireless communication channel about the end-of-train location and the train operator takes necessary action to avoid damage to the infrastructure.

Federal Railroad Operating Practices at 49 CFR 218.99 (e)(5) allow the use of shove lights for shove track protection, provided that the system is fail-safe. These federal railyard regulations outline a system based on circuit-based track occupancy detection and a shove light-based track occupancy indication system. The shove light system is configured to display the less favorable aspects of the system when the circuited section of the track is occupied. A limitation of the proposed system is that shove lights may not be visible in all weather conditions, such as dense fog. Another limitation is that shove lights installed at a fixed location may not be visible to the remote train operator.

U.S. Pat. No. 8,296,000 B2 discloses a system that makes use of axle counters to track rolling stock inside a railyard. A central controller collects the axle counts reported by the axle counters installed at various locations inside the railyard to locate the rolling stock. The proposed system makes use of inductive wheel sensors attached to the rail of the railway track. The proposed system does not provide a mechanism for an early train alert to the train operator. Another limitation of the proposed system is poor localization accuracy due to the fact that the train detection can only be performed at locations where axle counters are installed.

Another conventional system is based on portable train detectors and an onboard operator alert device. A train detector based on dual ultrasonic sensors is placed adjacent to the rail to detect the train wheel movement. An issue in this system is the limited range of the ultrasonic sensor, which is around twenty inches, and as a result, requires that the detection unit be installed directly on one of the rails using special clamping means. Another limitation is that the dual ultrasonic sensors have a known failure point of decreased detection range when there are obstacles, such as water drops, on the surface of the emitter or receiver. In addition, the proposed system does not provide real-time end-of-train position information to the train operator.

Various other systems are designed to detect an oncoming train and provide early warning to railroad workers. One such system is disclosed in U.S. Pat. No. 10,518,792 B2, which provides reliable detection of trains and other railway vehicles to warn roadway workers about oncoming trains. This system is based on train detection modules installed at catenary poles along the mainline track, an onboard device, and handheld devices for roadway workers. The train detectors are based on redundant and diverse sensors. A wireless mesh network is used for communication between train detectors, onboard devices, and handheld devices for roadway workers. This system is specifically designed for roadway workers outside a railyard and is best suited for use in a long-range linear network orientation and may not be best suited for the complex multi-path networks formed in a typical railyard environment.

The conventional systems discussed above have undesirable limitations. Shove move protection optimized for real-time train localization and communication with the train operator to ensure the safety of the personnel as well as protecting the railyard infrastructure is needed. A fail-safe protection system that is well-suited for challenging railyard environments is also desirable.

SUMMARY

Aspects of the present disclosure provide a reliable and efficient method for the detection and localization of the end of a train while performing shove moves during the train switching process. Aspects of the present disclosure further provide a system that provides early audio, visual, and/or haptic feedback to the train operator through an onboard or handheld alert device to stop the train before entering a predefined prohibited zone. The system comprises diverse and redundant sensors to detect and localize the end of the train and deliver a timely alert to the train operator over a wireless communication network. The system also comprises wirelessly connected train position detectors, train range extender devices, onboard alert devices, and handheld alert devices.

Aspects of the present disclosure also permit train position detectors to be deployed at the track end, along the track, between the rails of the track, or a combination thereof, to detect and localize the train before entering the prohibited zone.

In an aspect, a shove move protection system for use in a multi-track railyard comprises a wireless mesh communication network and a train position detector configured to be communicatively coupled to the wireless mesh network that is associated with a railway track. The train position detector is configured to detect a localized position of a train traveling thereon while performing a shove move and to generate a detection signal indicative of the localized position when the train performing the shove move approaches a pre-defined buffer zone. The system also includes an onboard alert device communicatively coupled to the wireless mesh network. The onboard alert device is associated with the train performing the shove operation and is configured to receive the detection signal and to generate an onboard alarm in response thereto.

In another aspect, a method of providing shove move protection in a multi-track railyard comprises defining, by a train position detector, a detection zone within the multi-track railyard. The train position detector is associated with a railway track and communicatively coupled to a wireless mesh communication network. The method also includes detecting a localized position of a train traveling on the railway track during a shove move, generating a detection signal indicative of the localized position when the train performing the shove move approaches a pre-defined buffer zone, and communicating the detection signal to an onboard alert device communicatively coupled to the wireless mesh communication network and associated with the train performing the shove operation. The train position detector communicates the detection signal to the onboard via the wireless mesh communication network and the onboard alert device generates an onboard alarm in response to the communicated detection signal.

It is a further objective to perform train position detection with the help of a plurality of diverse and redundant sensors for detecting and localizing the trains in real-time.

It is a further objective that the train detection and localization algorithm adapts to multiple and technically diverse deployment environments.

It is a further objective that the train position detector monitors its own position and orientation to ensure accurate train detection and localization.

It is a further objective to report any violations by detecting and logging the impact of a train or any other on-track vehicle with the train position detectors installed at the end of the track.

It is a further objective that the train position detector wirelessly communicates with range extender devices, onboard alert devices, and handheld alert devices.

It is a further objective to provide real-time train location and estimated time of train entrance in the prohibited zone to the train operator.

It is a further objective to provide an alert to the train operator before the train enters the prohibited zone.

It is a further objective to utilize multiple diverse means of communication to deliver early alerts to the train operator.

It is a further objective to provide an early alert for the train operator even when some of the wireless communication links fail.

It is a further objective to provide an early warning to the train operator if a train position detector is no longer available for train detection and localization.

It is a further objective that both onboard alert devices and handheld alert devices utilize audio alerts, visual alerts, haptic alerts, or a combination thereof to provide a warning to the train operator.

It is a further objective to store all the warning alerts on local storage, cloud backend, or a combination thereof.

Other objects and features of the present disclosure will be in part apparent and in part pointed out herein.

BRIEF DESCRIPTION OF THE DRAWINGS

Corresponding reference numbers indicate corresponding parts throughout the drawings.

DETAILED DESCRIPTION

The embodiments described here relate to the safe shove moves of a train during the train switching process by avoiding the need for human-based track operations monitoring. The system is based on a communication network between train position detectors, range extender devices, onboard alert devices, and handheld alert devices. The train position detectors are configured to detect and localize the end of the train on the track to be protected and provide an early alert to the train operator before the train enters a prohibited zone. The locomotive operator receives timely alerts from the train position detectors on an onboard alert device. A remote locomotive operator receives the alert on a handheld alert device.

Moreover, the embodiments described herein provide a reliable and efficient system configured to detect a train, localize it on the track, and provide a combination of visual, audio, and haptic alerts to the train operator to stop the train before it enters a prohibited zone. The embodiments utilize multiple diverse sensors to detect a train and localize it on the track in real-time. The train detection and localization sensors include a combination of RADAR, LiDAR, vision sensors, and inertial measurement units (IMUs). In addition to the redundancy of sensors in a train position detector, redundant train position detectors can be installed to detect and localize a train on the track. A train position detector installed at the end of a track can localize a train in real-time when the train is at a safe stopping distance from the prohibited zone. In addition, a train position detector can be installed at a suitable location along the track, between the track, or end of the track to detect the train near that specific position. The train position detectors are configured to generate an early alert for the train operator before the train enters the prohibited zone. The alerts may be delivered over a wireless mesh communication network utilizing ISM band radios operating in the industrial scientific and medical (ISM) frequency bands, ubiquitous cellular networks, or a combination thereof. A cloud backend may be used to provide remote configuration management of the train position detectors, range extender devices, onboard alert devices, and handheld alert devices. In addition, a cloud backend may also be used to log warning alerts and other useful information for diagnostic purposes. Multiple range extender devices may be installed inside a railyard to increase the wireless communication range and provide redundant communication paths. The train operator may receive real-time train location and warning alerts through an onboard alert device. A remotely controlled locomotive operator may receive train location information and warning alerts on a handheld alert device. The system and methods described herein include various configurations, and as a result, the description and figures should be understood as exemplary.

Figure 1:
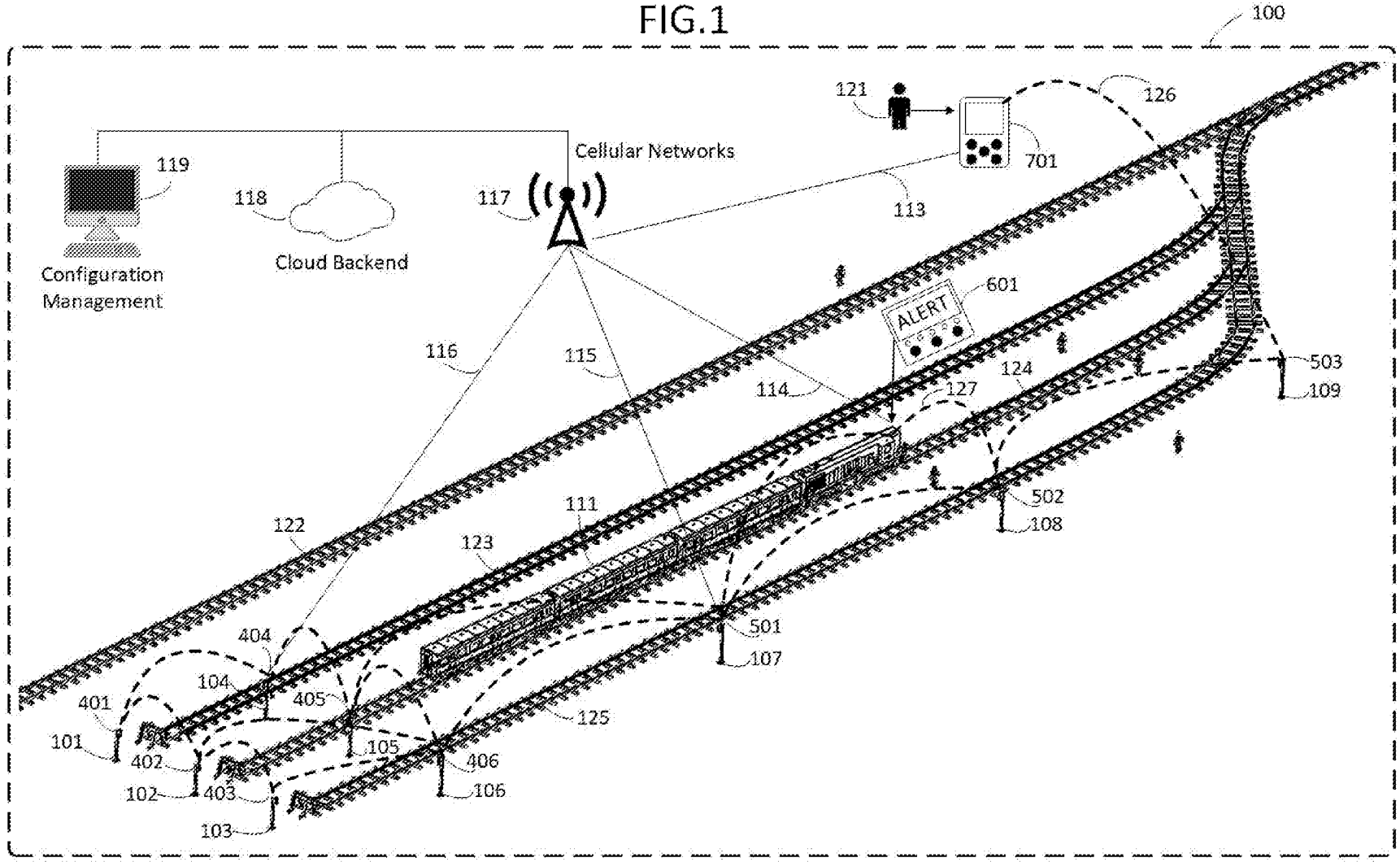
FIG. 1 is a system diagram providing an overview of railyard tracks equipped with an exemplary system for shove track protection wherein the system comprises a wireless network of train position detectors, wireless range extenders, onboard alert devices, and handheld alert devices.

FIG. 1 is a system diagram showing a railyard 100 equipped with the shove track protection system according to one preferred embodiment of the present invention. The exemplary railyard 100 consists of four tracks 122, 123, 124, and 125. The end of the tracks 123, 124, and 125 are equipped with train position detectors (TPDs) 401, 402, and 403, respectively. The TPDs 401, 402, and 403 are installed on poles 101, 102, and 103, respectively. Each of the TPDs 401, 402, and 403 are facing toward the trains along the respective tracks 123, 124, and 125, and configured to detect and localize a train in real-time. Three additional TPDs 404, 405, and 406 are installed at the sides of tracks 123, 124, and 125 on poles 104, 105, and 106, respectively. The TPDs 404, 405, and 406 installed on the tracks 123, 124, and 125 respectively, are configured to detect a train passing in front of them. In the exemplary embodiment, all the TPDs 401, 402, 403, 404, 405, and 406 are installed on the poles 101, 102, 103, 104, 105, and 106 respectively, however, any other fixed or portable structure can be used. Three range extender devices 501, 502, and 503 are shown to be installed on poles 107, 108, and 109 along the track 125.

A train 111 is shown to be performing a shove move on track 124. In the exemplary embodiment, the train 111 is equipped with an onboard alert device (OAD) 601, which is capable of wirelessly communicating with the TPDs and range extender devices (REDs). The OAD 601 may receive warning alerts from the TPDs over the radio interface operating in ISM frequency bands 127, cellular interface 114, or a combination of both. In some cases, the train 111 may be operated by a remote operator using a remote-control unit. In such cases, a remote train operator 121 is shown to be equipped with a handheld alert device (HAD) 701. The HAD 701 is a portable device having alerting capabilities similar to the OAD 601. The HAD 701 can receive warning alerts from the TPDs on the wireless mesh communication network of radios operating in ISM frequency bands 126, cellular interface 113, or a combination thereof.

The TPDs 401, 402, 403, 404, 405, 406, REDs 501, 502, 503, OAD 601, and HAD 701 form a peer-to-peer communication network by using the radios operating in ISM frequency bands, through a cellular network interface using 5G or any other future generations of the cellular network 117, or a combination thereof. All or a subset of the devices in the proposed system can be equipped with the cellular interface. In the exemplary embodiment, TPD 404, RED 501, OAD 601, and HAD 701 utilize cellular interfaces 114, 115, 116, and 113, respectively. All the other devices without a cellular network interface can use the cellular interface of the TPD 404, RED 501, OAD 601, and HAD 701 for any cellular network services required.

The proposed system generates various events, such as a TPD generating alerts to the train operator and intermittent communication link failures, during the train switching process in the railyard 100. All the important events are logged locally on the devices and also on a cloud backend 118 for remote retrieval and event statistics generation. The system is also capable of remote configuration management 119, such as updating the TPD detection range to customize the system for varying installation environments. The remote configuration management 119, in addition, also provides remote application updates for the TPDs, REDs, HADs, and OADs.

Figure 2:
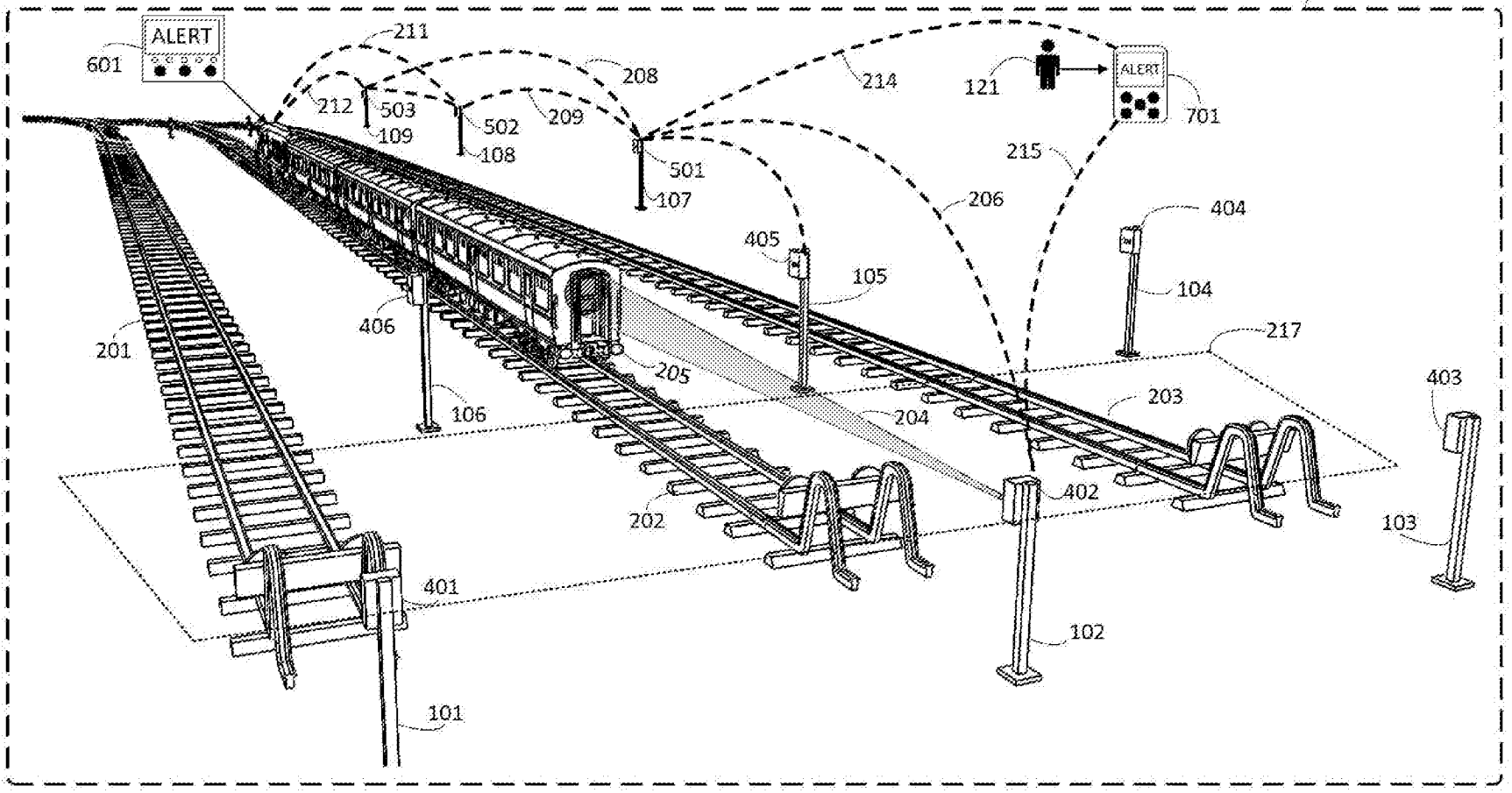
FIG. 2 illustrates redundant train position detectors-based train detection, localization, and alert propagation to the train operator through multiple wireless communication links.

FIG. 2 shows the process of train detection, localization, and reporting to the train operator. The train detection, localization, and warning alert delivery require real-time response to allow the operator to stop the train before it reaches the end of the track. The exemplary railyard 200 is equipped with the proposed shove track protection system and consists of three tracks 201, 202, and 203. A segment at the end of every track is configured as a buffer zone 217 for the train where an entry of the train warrants a warning alert to the train operator. The TPDs 401, and 406 are installed on poles 101, and 106, respectively, and configured to detect and localize a train on track 201. Similarly, TPDs 403, and 404 are installed on poles 103, and 104, respectively, and configured to detect and localize a train on track 203. A train 205 is shown to be performing a shove move on track 202. TPD 402 is installed on pole 102 and configured to detect and localize train 205 well before it enters buffer zone 217. A LiDAR beam 204 is shown to be emitting from the TPD 402 to accurately localize train 205 on track 202. TPD 405 is installed at pole 105 located at the outer border of buffer zone 217 on track 202 and configured to detect a train when it reaches in front of it. Three REDs 501, 502, and 503 are installed on poles 107, 108, and 109 along track 203 to provide better wireless communication coverage. A remote train operator 121 is equipped with a HAD 701 to receive warning alerts generated by the TPDs 402 and 405. Locomotive on train 205 is equipped with an OAD 601 to receive warning alerts from the TPDs 402 and 405.

Train 205 performs various shove moves on track 202 during a train switching process. When train 205 enters the detection range of the TPD 402, its real-time location is transmitted to the train operator. Subsequently, the TPD 402 reports the up-to-date train location on track 202 to the train operator. TPD 402 compares the real-time train location with a pre-configured threshold and transmits a warning alert to the train operator when train 205 is located inside buffer zone 217 on track 202. The TPD 402 keeps reporting the real-time location of train 205 to the operator when the train is in its detection range. The exemplary system shows a secondary TPD 405 on pole 105 along track 202. TPD 405 is facing toward the track and detects a train when it is in front of it. TPD 402 is strategically installed at a suitable location where train detection necessitates a warning alert to the operator. The proposed shove track protection system may utilize one or both TPDs depending upon the needs of a railyard.

The TPDs 402 and 405 transmit real-time train location and warning alerts to the train operator through cellular networks 117 in FIG. 1, a mesh network of the radios operating in ISM frequency bands, or a combination thereof. The exemplary scenario in FIG. 2 shows a part of the wireless mesh communication network from the TPDs 402 and 405 to the train HAD 701 and OAD 601. A remote train operator 121 can receive a warning alert directly from TPD 402 on communication link 215. In addition, HAD 701 can also receive a warning alert through communication links 206 and 214 from TPD 402. An onboard locomotive operator can receive real-time train location and warning alerts from the TPD 402 on various redundant communication links available. One such possible communication path is 206, 208, and 212. Another redundant communication path is 206, 209, and 211. The exemplary scenario shows only a few possible communication links, however, every unordered pair of both REDs and TPDs might have a communication link between them.

Figure 3:
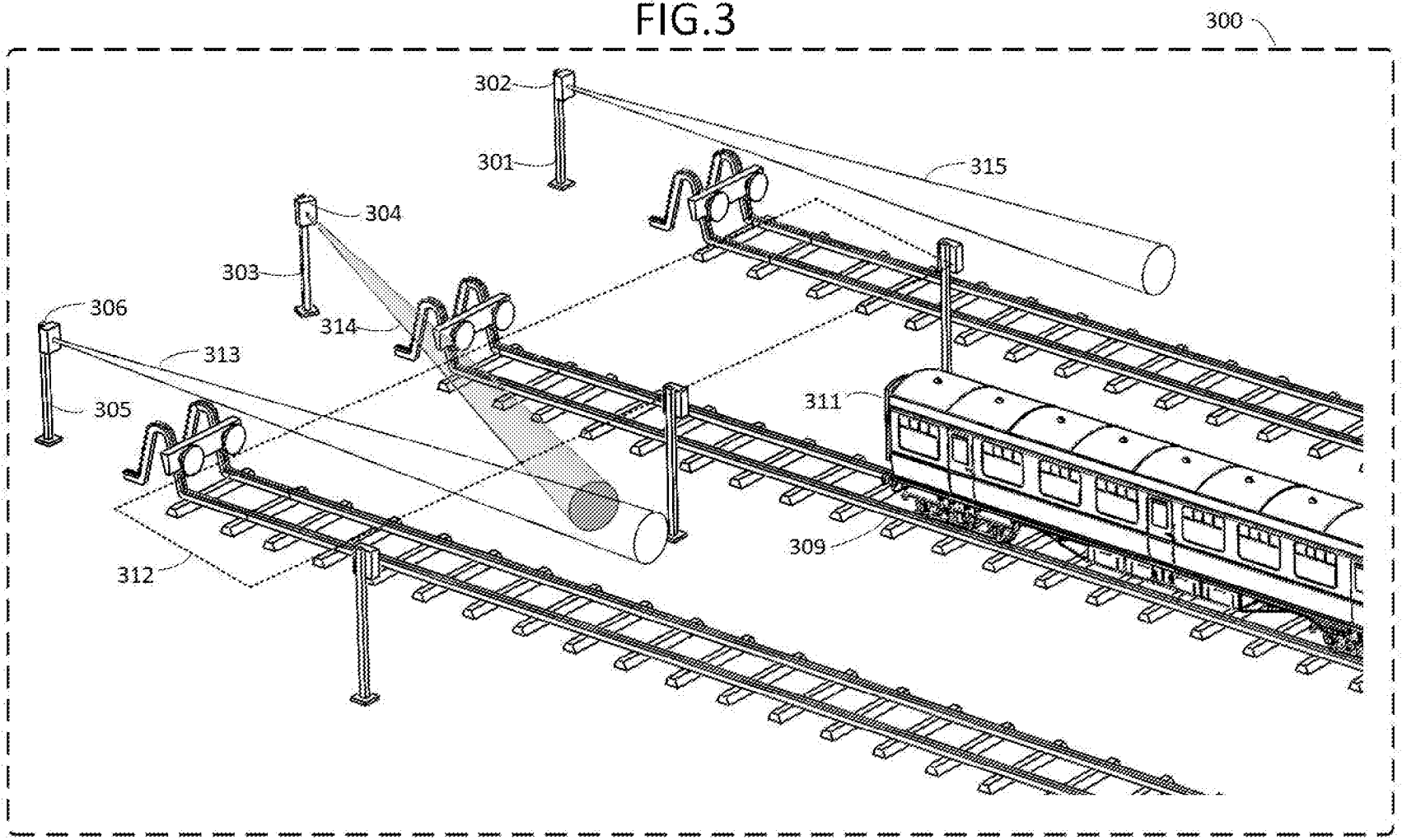
FIG. 3 illustrates train position and orientation monitoring features of the shove track protection system of FIG. 1.

FIG. 3 shows the self-monitoring capability of the proposed shove track protection system in the exemplary railyard 300. Three TPDs 302, 304, and 306 are shown to be installed on poles 301, 303, and 305, respectively. A train 311 is performing a shove move toward buffer zone 312 on track 309. To accurately detect and localize train 311 on track 309, the TPD 304 is required to be positioned such that track 309 is directly in the view of train detection and localization sensors installed in the TPD 304. The LiDAR beams 313 and 315 emitting from TDPs 306 and 302, respectively, are properly aligned along the respective tracks. The orientation of TPD 304 is shown to be changed over time or suddenly due to impact with a train or any other on-track vehicle. The LiDAR beam 314 is not aligned with track 309 because of the change in orientation of TPD 304. For accurate train detection and localization, the LiDAR beam 314 from TDM 304 is required to be aligned along the track 309, similar to LiDAR beams 313 and 315 from TPDs 306 and 302, respectively. The self-monitoring capability of the TPDs detects any change in the orientation of the TPD 304 and reports this issue to both the train operator and the cloud backend. The self-monitoring capability makes the TPD-based train detection and localization fail-safe in the face of orientation or position change.

Figure 4:
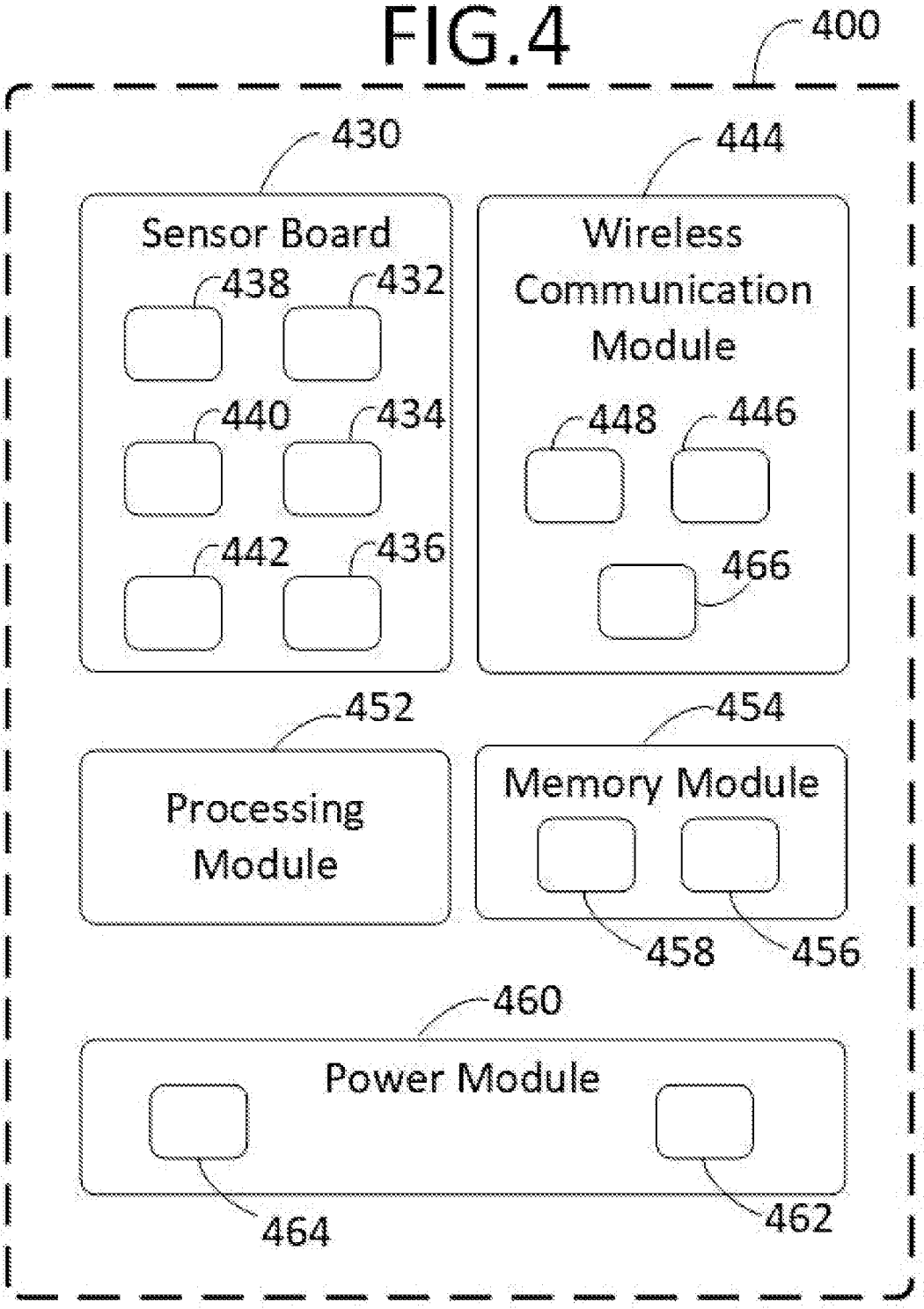
FIG. 4 is a block diagram of the components of the train position detector of FIG. 1.

FIG. 4 shows components of the train position detector (TPD) 400. A sensor board 430 on the TPD 400 comprises various sensors to detect and localize trains on track. The sensor board 430 includes a multi-beam LiDAR 438 that generates a 3D point cloud of the surrounding in front of it. The LiDAR 438 periodically emits beams of infrared pulses and generates the 3D point cloud from the reflected waves. The point cloud is used to sense the presence, distance, and direction of the train. Another sensor used on the sensor board 430 is RADAR 432. The RADAR 432 continuously emits frequency-modulated radio waves and when a train or any other on-track vehicle is in the viewing angle of the RADAR 432, a certain portion of the waves is reflected to the RADAR. The RADAR 432 processes the reflected waves and determines the size of the detected object along its distance from TPD 400 along with its speed and direction. The sensor board 430 also includes a laser range finder 440 that continuously emits a laser beam and detects the presence of a train from a portion of the reflected waves. A vision sensor 434 on the sensor board reports compressed images which are further used to detect the presence of a train or any other on-track vehicle. The vision sensor 434 is accompanied by an infrared transmitter to make it useable in low light conditions. The sensor board 430 also includes a vibration and orientation sensor, which can be an inertial measurement unit (IMU) 442. The IMU 442 can be used to detect the presence of a train by sensing the vibration pattern. Furthermore, the IMU 442 is also used to determine the orientation of the TPD 400 which can change over time or suddenly due to impact by other objects or environmental conditions such as strong winds or snow. In addition to the above-mentioned sensors, the sensor board 430 may also include a transducer and filter module 436 which converts analog signals to digital format and applies necessary filters to the data generated by raw sensors.

The TPD 400 also includes a wireless communication module 444. The wireless communication module 444 may use more than one radio for reliable and low latency communications. In the exemplary embodiment, the primary 448 and optional secondary 446 radio operate in different channels of the unlicensed ISM band. Both primary 448 and secondary 446 radios are used to establish and maintain a mesh communication network between the TPDs, REDs, OADs, and HADs. The 5G modem 466 may also be used for communication between the TPDs, REDs, OADs, and HADs. The processing module 452 is responsible for the execution of TPD 400 software which includes functions such as performing startup verification of various sensors and I/O modules, processing signals and data received from various sensors for making decisions, and preparation of data packets to be transmitted to the connected devices through the wireless mesh communication network. The configuration parameters and other diagnostic information for various components available on the TPD 400 are stored in non-volatile memory 458 present in the memory module 454. A real-time clock RTC 456 is included in the memory module 454 for various time-keeping purposes. The TPD 400 includes a power module 460 for providing power to various components available on the TPD 400. The power module 460 includes a backup battery that provides power backup to TPD 400. The exemplary embodiment shows a rechargeable lithium-ion battery 464, however, any other suitable battery to provide backup to train detection and localization components may be used as an alternative. A power supply unit 462 available in the power module 460 provides regulated power to all the components of the TPD 400. The power module 460 also includes a battery monitoring and conditioning system which generates alerts in case the backup battery is nearing depletion.

Figure 5:
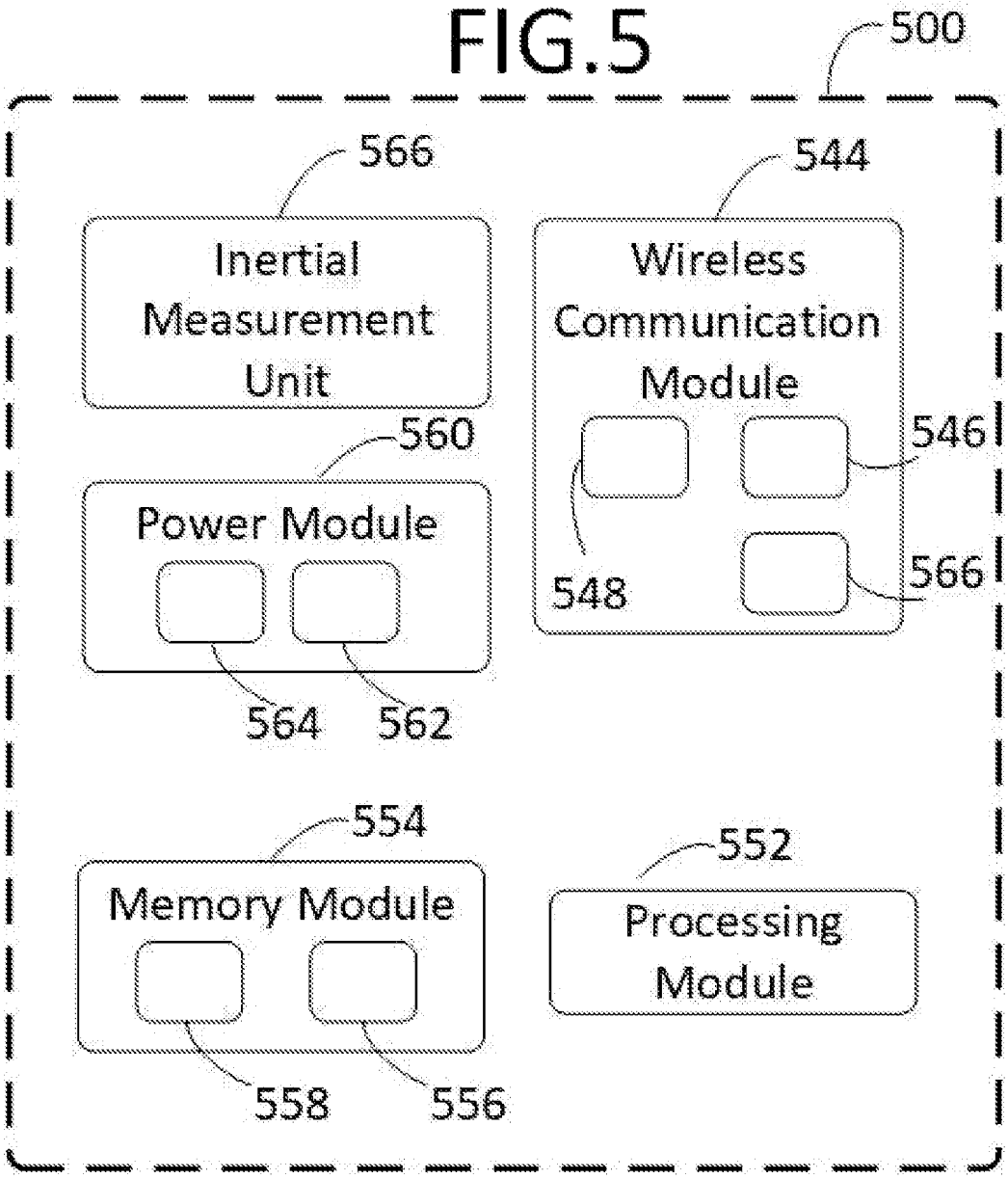
FIG. 5 is a block diagram of the various components of the range extender device of FIG. 1.

FIG. 5 shows components of the range extender device (RED) 500. The IMU 566 is used to determine the orientation of the RED 500 which may change over time or due to a sudden impact by other objects or environmental conditions such as strong winds or snowstorms. The wireless communication module 544 may use single or multiple radios to provide fast and reliable communications. The primary 548 radio and an optional secondary 546 radio can be used to create a mesh communication network between the TPDs, REDs, OADs, and HADs. The RED 500 may use one or multiple active radios at a time depending upon congestion in the radio channels being used. The 5G modem 566 may also be used for communication between the TPDs, REDs, OADs, and HADs. A power supply unit 564 available in the power module 560 provides regulated power to all the available components on the RED 500. The power module 560 includes a battery that provides battery backup to the RED 500. The exemplary embodiment uses a rechargeable lithium-ion battery 562, however, any other suitable battery can be used as an alternative. The power module 560 also includes a battery monitoring and conditioning system which generates alerts in case the battery is approaching charge depletion. The non-volatile memory 558 in the memory module 554 is used to store various application configuration parameters and system diagnostic events. A real-time clock (RTC) 556 is used for time-keeping purposes such as time-stamping the system diagnostic events. The processing module 552 is responsible for running the software required to relay received signals to all the devices in the wireless communication range of RED 500.

Figure 6:
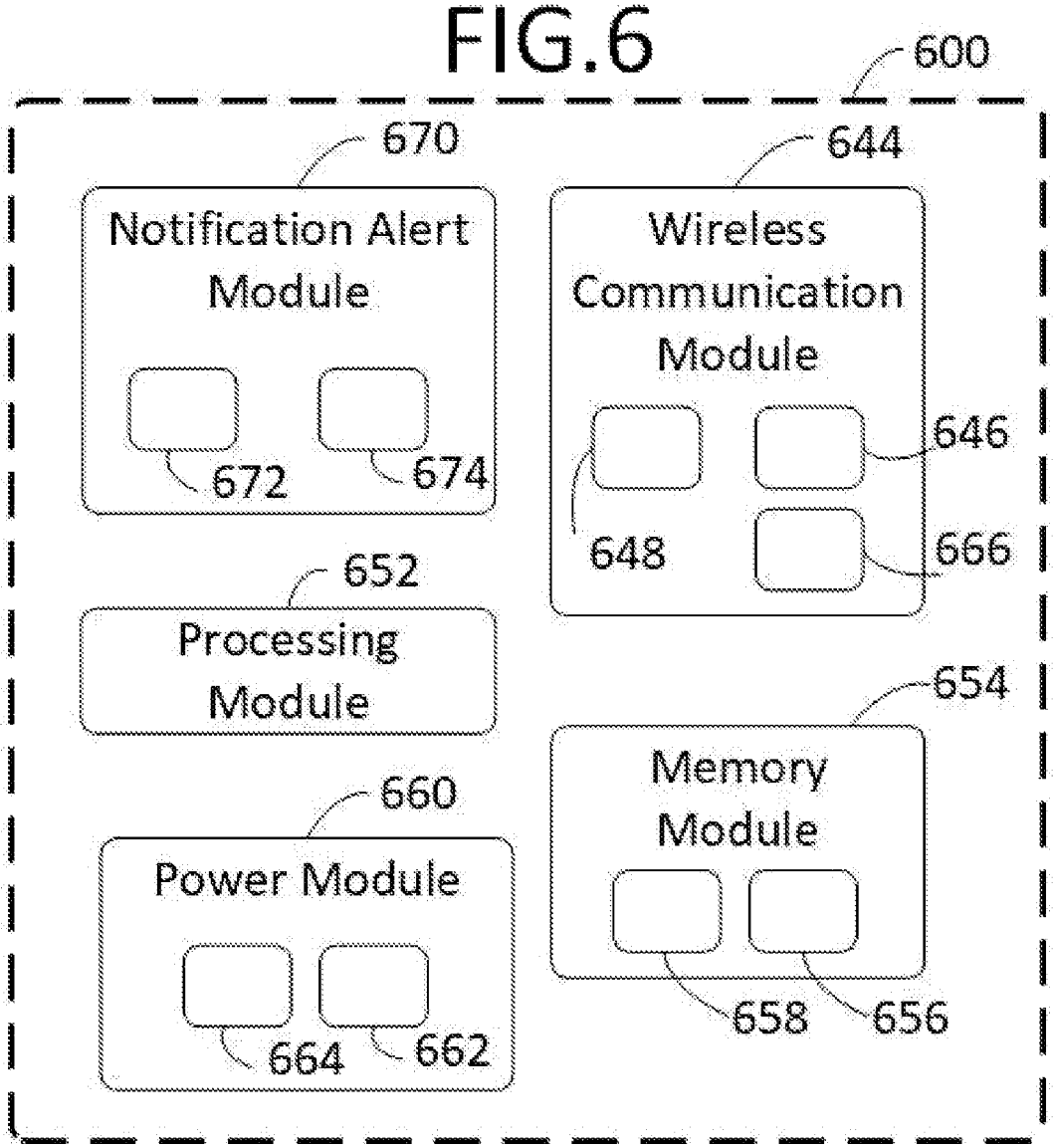
FIG. 6 is a block diagram of the components of the onboard alert device of FIG. 1.

FIG. 6 shows components of the onboard alert device (OAD) 600. The notification alert module 670 includes at least one audible alert device 672 which can be a buzzer and a visual alert device 674 which can be an LCD or an array of LEDs. The notification alert module 670 may also provide a mechanism to acknowledge the reception of warning alerts. The wireless communication module 644 is used to create a peer-to-peer wireless mesh network with other devices in the network. The wireless communication module 644 may include one or more radios for reliable and low latency radio communications. The exemplary embodiment shows two radio modules, primary radio 648 and an optional secondary radio 646, which operate in the ISM frequency bands. The OAD 600 may use multiple active radios at a time depending upon the reported congestion in the radio channels used. The 5G modem 666 may also be used for wireless communication between the TPDs, OADs, and HADs. The non-volatile memory 658 available in the memory module 654 is used to store various application configuration parameters and system diagnostic events. The RTC 656 is used for all time-keeping purposes, i.e., time-stamping the system diagnostic events. A power supply unit 664 available in the power module 660 provides regulated power to all the available components on the OAD 600. The power module 660 includes a battery that provides battery backup to personal alert device 600. The exemplary embodiment utilizes a rechargeable lithium-ion battery 662, however, any other suitable battery can be used as an alternative. The processing module 652 is responsible for executing the software that implements the functionality of the OAD 600.

Figure 7:
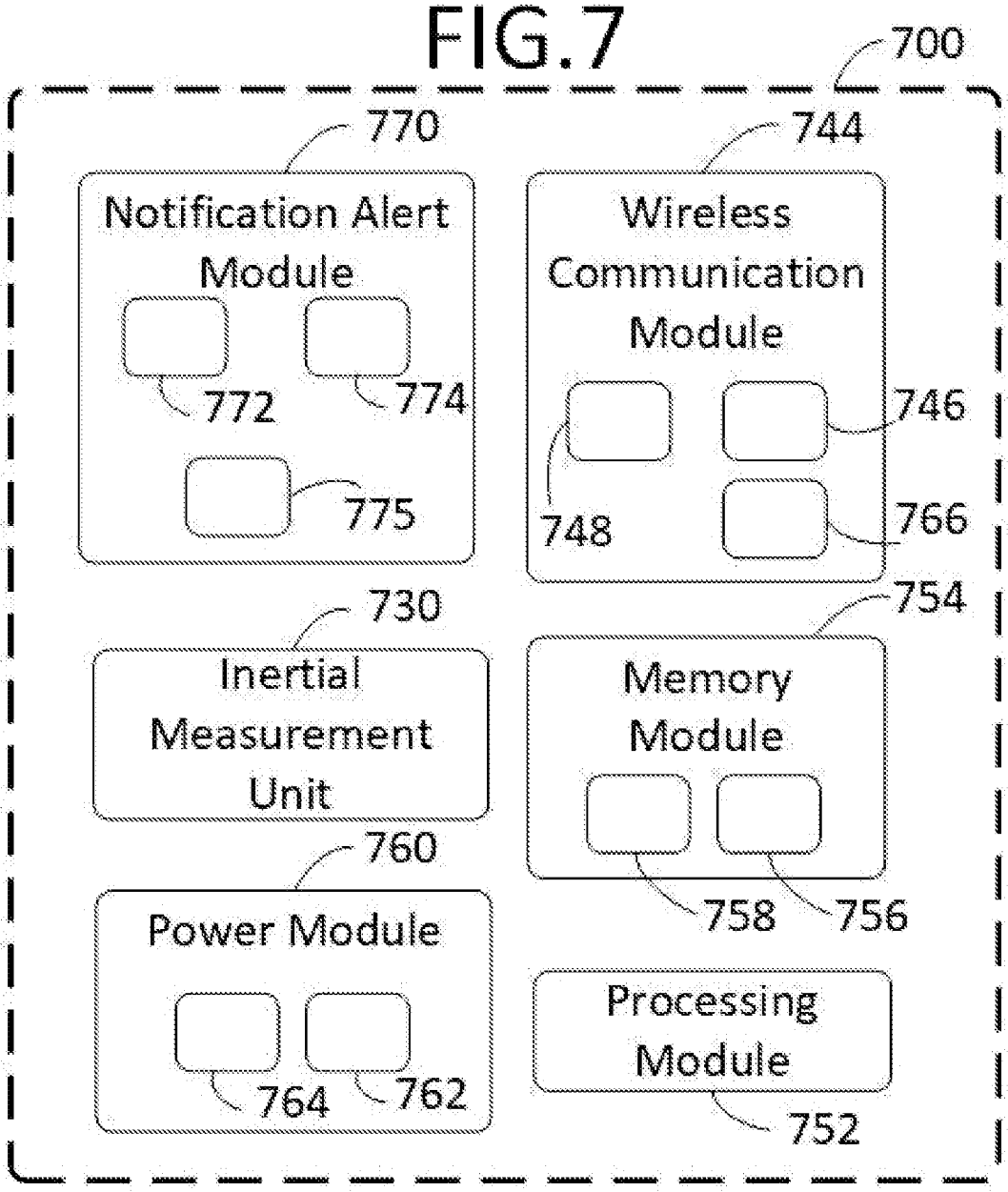
FIG. 7 is a block diagram showing various components of the handheld alert device of FIG. 1.

FIG. 7 shows components of the handheld alert device (HAD) 700. The notification alert module 770 comprises at least one audible alert device 772 which can be a buzzer, a visual alert device 774 which can be an LCD or LEDs, and a haptic feedback device 775 which can be a vibration motor as used in the preferred embodiment. The wireless communication module 744 is used to create a peer-to-peer wireless mesh network with other devices in the network. The wireless communication module 744 comprises at least one radio for reliable and near real-time radio communication. The exemplary embodiment shows two radio modules, the primary radio 748 and an optional secondary radio 746 operating in the ISM frequency bands. The HAD 700 may use multiple active radios at a time depending upon the reported network response time. The 5G modem 766 may also be used for wireless communication between the TPDs, OADs, and HADs. The non-volatile memory 758 included in the memory module 754 is used to store various application configuration parameters and system diagnostic events. An RTC 756 is used for all time-keeping purposes, i.e., time-stamping the system diagnostic events. The power supply unit 764 available in the power module 760 provides regulated power to all the available components on the HAD 700. The power module 760 also includes a battery that provides battery backup to the personal alert device 700. The exemplary embodiment utilizes a rechargeable lithium-ion battery 762, however, other battery types can also be used. The processing module 752 is responsible for the execution of HAD 700 software which may include steps such as performing startup verification of various sensors and I/O, routing messages, and relaying warning alerts to the train operator using various means including audio, visual, and haptic feedback.

When introducing elements of aspects of the invention or the embodiments thereof, the articles "a," "an," "the," and "said" are intended to mean that there are one or more of the elements. The terms "comprising," "including," and "having" are intended to be inclusive and mean that there may be additional elements other than the listed elements.

Not all of the depicted components illustrated or described may be required. In addition, some implementations and embodiments may include additional components. Variations in the arrangement and type of the components may be made without departing from the spirit or scope of the claims as set forth herein. Additional, different or fewer components may be provided and components may be combined. Alternatively, or in addition, a component may be implemented by several components.

The above description illustrates the aspects of the invention by way of example and not by way of limitation. This description enables one skilled in the art to make and use the aspects of the invention, and describes several embodiments, adaptations, variations, alternatives and uses of the aspects of the invention, including what is presently believed to be the best mode of carrying out the aspects of the invention. Additionally, it is to be understood that the aspects of the invention are not limited in its application to the details of construction and the arrangement of components set forth in the following description or illustrated in the drawings. The aspects of the invention are capable of other embodiments and of being practiced or carried out in various ways. Also, it will be understood that the phraseology and terminology used herein is for the purpose of description and should not be regarded as limiting.

It will be apparent that modifications and variations are possible without departing from the scope of the invention defined in the appended claims. As various changes could be made in the above constructions and methods without departing from the scope of the invention, it is intended that all matter contained in the above description and shown in the accompanying drawings shall be interpreted as illustrative and not in a limiting sense.

In view of the above, it will be seen that several advantages of the aspects of the invention are achieved and other advantageous results attained.

The Abstract and Summary are provided to help the reader quickly ascertain the nature of the technical disclosure. They are submitted with the understanding that they will not be used to interpret or limit the scope or meaning of the claims. The Summary is provided to introduce a selection of concepts in simplified form that are further described in the Detailed Description. The Summary is not intended to identify key features or essential features of the claimed subject matter, nor is it intended to be used as an aid in determining the claimed subject matter.

What is claimed is:

1. A shove move protection system for use in a multi-track railyard, the shove protection system comprising:

a wireless mesh communication network;

at least one train position detector communicatively coupled to the wireless mesh communication network and associated with a railway track, the train position detector configured to detect a localized position of a train traveling on the railway track during a shove move and to generate a detection signal indicative of the localized position when the train performing the shove move approaches a pre-defined buffer zone, wherein the train position detector is further configured to generate the detection signal before the train enters the pre-defined buffer zone; and an onboard alert device associated with the train performing the shove move, the onboard alert device communicatively coupled to the wireless mesh communication network and configured to receive the detection signal from the train position detector via the wireless mesh communication network and to generate an onboard alarm in response thereto.

2. The system of claim 1, further comprising at least one personal alert device communicatively coupled to the wireless mesh communication network, the personal alert device being portable, the personal alert device configured to receive the detection signal from the train position detector via the wireless mesh communication network and to generate a personal alarm in response thereto.

3. The system of claim 2, wherein the train position detector, the onboard alert device, and the personal alert device comprise nodes on the wireless mesh communication network.

4. The system of claim 2, wherein the personal alert device is configured to generate the personal alarm using at least one of a visual feedback, haptic feedback, and audio feedback.

5. The system of claim 1, wherein the onboard alert device is configured to generate the onboard alarm using at least one of a siren and a strobe light.

6. The system of claim 1, wherein the train position detector is positioned at an end of a railway track and is configured to detect the localized position of the train performing the shove move when said train approaches the train position detector.

7. The system of claim 1, further comprising a second train position detector configured to be positioned at a side of a railway track and to detect the localized position of the train performing the shove move when said train passes the second train position detector.

8. The system of claim 1, wherein the train position detector defines a detection zone and is further configured to provide real-time position information for a train traveling within the detection zone.

9. The system of claim 1, wherein the wireless mesh communication network utilizes ISM band radios operating in industrial scientific and medical (ISM) frequency bands, cellular networks, or a combination thereof.

10. The system of claim 1, wherein the wireless mesh communication network is configured to utilize multiple means of wireless communication to deliver the detection signal such that if a first means of wireless communication fails to communicate the signal, a second means of wireless communication communicates the signal.

11. The system of claim 10, wherein the means of wireless communication comprises at least one of an XBEE module, ZigBee, Bluetooth classical, Bluetooth low energy, Wi-Fi, universal software radio peripheral, software-defined radio, Cellular Data Networks, 900 MHz radio band, 2.4 GHz radio band, and 5 GHz radio band.

12. The system of claim 1, wherein the train position detector comprises a range sensor and a proximity sensor configured to determine a location of the train and a direction of travel of the train relative to the determined location.

13. The system of claim 12, wherein the range sensor comprises at least one of a vision sensor and a RADAR detector.

14. The system of claim 12, wherein the proximity sensor comprises at least one of a LIDAR detector and a laser range finder.

15. The system of claim 1, wherein the train position detector comprises a first train position detector, and further comprising a second train position detector communicatively coupled to the wireless mesh communication network and associated with a second railway track, wherein the first train position detector and the second train position detector are configured to use different means of position detection.

16. A method of providing shove move protection in a multi-track railyard, the method comprising:

defining, by a train position detector, a detection zone within the multi-track railyard, wherein the train position detector is associated with a railway track and communicatively coupled to a wireless mesh communication network;

detecting, by the train position detector, a localized position of a train traveling on the railway track during a shove move;

generating, by the train position detector, a detection signal indicative of the localized position when the train performing the shove move approaches a pre-defined buffer zone, wherein the detection signal is generated before the train enters the pre-defined buffer zone; and communicating, by the train position detector, the detection signal to an onboard alert device communicatively coupled to the wireless mesh communication network and associated with the train performing the shove move, wherein the train position detector communicates the detection signal to the onboard alert device via the wireless mesh communication network, and wherein the onboard alert device generates an onboard alarm in response to the communicated detection signal.

17. The method of claim 16, further comprising communicating, by the train position detector, the detection signal to at least one personal alert device communicatively coupled to the wireless mesh communication network, wherein the personal alert device generates a personal alarm in response to the communicated detection signal.

18. The method of claim 17, wherein the train position detector, the onboard alert device, and the personal alert device comprise nodes on the wireless mesh communication network.

19. The method of claim 16, further comprising positioning the train position detector at an end of the railway track, and wherein detecting the localized position of the train includes detecting when said train approaches the train position detector.

20. The method of claim 16, further comprising providing, by the train position detector, real-time position information for the train traveling within the detection zone.

* * * * *